US009364035B1

(12) United States Patent
Shachaf

(10) Patent No.: US 9,364,035 B1
(45) Date of Patent: Jun. 14, 2016

(54) ADJUSTABLE CLOTHING GARMENT

(71) Applicant: Ziva Shachaf, San Antonio, TX (US)

(72) Inventor: Ziva Shachaf, San Antonio, TX (US)

( * ) Notice: Subject to any disclaimer, the term of this patent is extended or adjusted under 35 U.S.C. 154(b) by 0 days.

(21) Appl. No.: 14/586,763

(22) Filed: Dec. 30, 2014

(51) Int. Cl.
*A41D 15/00* (2006.01)
*A41B 1/08* (2006.01)
*A41D 1/00* (2006.01)

(52) U.S. Cl.
CPC . *A41D 15/00* (2013.01); *A41B 1/08* (2013.01); *A41D 1/00* (2013.01)

(58) Field of Classification Search
CPC ..... A41D 15/00; A41D 9/08; A41D 15/02; A41D 1/20; A41D 1/22; A41D 27/10; A41B 9/08
USPC ..... 2/69, 70, 71, 72, 212, 213, 74, 75, 76, 2/115, 126
See application file for complete search history.

(56) References Cited

U.S. PATENT DOCUMENTS

| | | | | | |
|---|---|---|---|---|---|
| 2,521,020 | A | * | 9/1950 | Prescott | 2/70 |
| 2,899,962 | A | * | 8/1959 | Entringer et al. | 450/95 |
| 3,002,193 | A | * | 10/1961 | Briskman | A41D 1/00 2/72 |
| 3,418,659 | A | * | 12/1968 | Brown | 2/70 |
| 3,961,376 | A | * | 6/1976 | Howell | 2/71 |
| 5,095,549 | A | * | 3/1992 | Aldridge | 2/304 |
| 5,173,965 | A | * | 12/1992 | Panner | 2/105 |
| 5,628,064 | A | * | 5/1997 | Chung | 2/70 |
| 5,774,892 | A | * | 7/1998 | Tisdale et al. | 2/69 |
| 8,806,664 | B1 | | 8/2014 | Judge et al. | |

FOREIGN PATENT DOCUMENTS

GB 2309626 * 8/1997

* cited by examiner

*Primary Examiner* — Tejash Patel
(74) *Attorney, Agent, or Firm* — Patrick J. S. Inouye; Krista A. Wittman

(57) ABSTRACT

An adjustable clothing garment is provided. A clothing item shaped to cover at least a portion of a wearer's body and having attached on a bottom edge, a series of snaps is provided. A connecting clothing item having a substantially circular shape with a series of snaps affixed on a top edge that correspond with the series of snaps on the clothing item is provided.

10 Claims, 6 Drawing Sheets

ADJUSTABLE CLOTHING GARMENT

FIELD

This application relates in general to clothing and, in particular, to an adjustable clothing garment.

BACKGROUND

Clothing offers wearers many benefits, such as warmth, protection from adverse weather or environmental conditions, and safety from infectious and toxic materials. Clothing also offers individuals a way to visually express themselves via clothing color, style, and fit. However, despite a practical need, the cost of clothing can be extremely expensive, due not only to the actual cost of the clothing, but based on a number of items required for outfits for different occasions. For example, work attire for women often includes business casual clothing, including slacks, skirts, blouses, and sweaters. In contrast, evening attire, depending on the event, can include a more dressed up look, such as a dress, for going out to dinner, a bar, or a dance club. Evening attire can also include formal wear, such as gowns and cocktail dresses, for presentations, awards ceremonies, and charity events. Buying clothes for each event can be costly; however, clothing expenses can be decreased for a wearer if the wearer is able to purchase fewer pieces, which can be used for multiple outfits on multiple occasions.

In addition to the high cost, large amounts of clothing items require lots of storage space and can be a burden to pack for trips. For example, packing for a trip can be difficult based on a number of clothing items required for different outfits to be worn during the trip. Also, airlines currently charge passengers to check in luggage and thus, many passengers are attempting to pack lighter to avoid the luggage fees, which apply to both initial and return flights.

Adaptable clothing garments can reduce a number of clothing items needed for different outfits, as well as clothing expenses due to the reduced number of items needed. Currently, convertible cargo pants exist. Retail stores, such as Recreational Equipment, Inc. and Cabela's Incorporated sell cargo pants from different manufacturers that can transform into shorts. Specifically, the cargo pants include a pair of shorts with two lower leg coverings, one for each of the right and left legs, that can be zipped onto the shorts. However, the lower leg coverings are unable to attach to different clothing items to create a different outfit. For example, the lower leg coverings cannot attach to a shirt, dress, or skirt.

Further, U.S. Pat. No. 8,806,664, to Judge, provides a clothing garment that includes a combination hat and hood. In detail, the garment includes a cover that attaches to a neckline of the garment and an upper edge that attaches to the hat. The cover has an opening for a wearer's face and fits securely around the wearer's head to prevent wind and cold from the wearer's neck. Thus, the cover is designed specifically for a wearer's face and is not suitable for attaching to a different clothing item, such as a shirt, dress, or skirt, due to the opening for the face, to create a different outfit.

Accordingly, there remains a need for clothing that is easily adaptable to create different outfits with existing clothing items. Preferably, an interchangeable clothing item can be attached to different types of clothing items, such as skirts, shirts, and dresses to change a style and look of the different clothing items.

SUMMARY

Adaptable clothing includes convertible items that allow individuals to create different outfits. For example, a shirt can be converted to a dress using an interchangeable clothing trim. Specifically, a bottom hem of the shirt can include a series of snaps around the bottom hem. A series of corresponding snaps can also surround an upper trim of the interchangeable clothing trim, which is removably affixed to the shirt by connecting the snaps of the shirt and the corresponding snaps of the interchangeable clothing trim. Addition of the interchangeable clothing trim extends a length of the shirt to an appropriate dress length and can provides a more finished look to the dress, by having a ruffle or wavy trim. The interchangeable clothing trim can also be added to shirts to make a tunic, or added to different clothing items, such as skirts and dresses for changing a length and style of the skirts and dresses.

An embodiment provides a convertible clothing garment. An adjustable clothing garment is provided. A clothing item shaped to cover at least a portion of a wearer's body and having attached on a bottom edge, a series of snaps is provided. A connecting clothing item having a substantially circular shape with a series of snaps affixed on a top edge that correspond with the series of snaps on the clothing item is provided.

Still other embodiments of the present invention will become readily apparent to those skilled in the art from the following detailed description, wherein are described embodiments by way of illustrating the best mode contemplated for carrying out the invention. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

DETAILED DESCRIPTION

Purchasing clothing for multiple occasions can be expensive and require many different items. In contrast, adaptable clothing allows a wearer to purchase fewer items that can be combined to create different outfits that are appropriate for more than one occasion. For example, a woman may wear a shirt and slacks to work during the day and after work quickly change to a dress for dinner by converting the shirt to a dress. A convertible outfit helps a wearer to cut clothing costs and easily convert one outfit to another without requiring many different clothing items.

Figure 1:
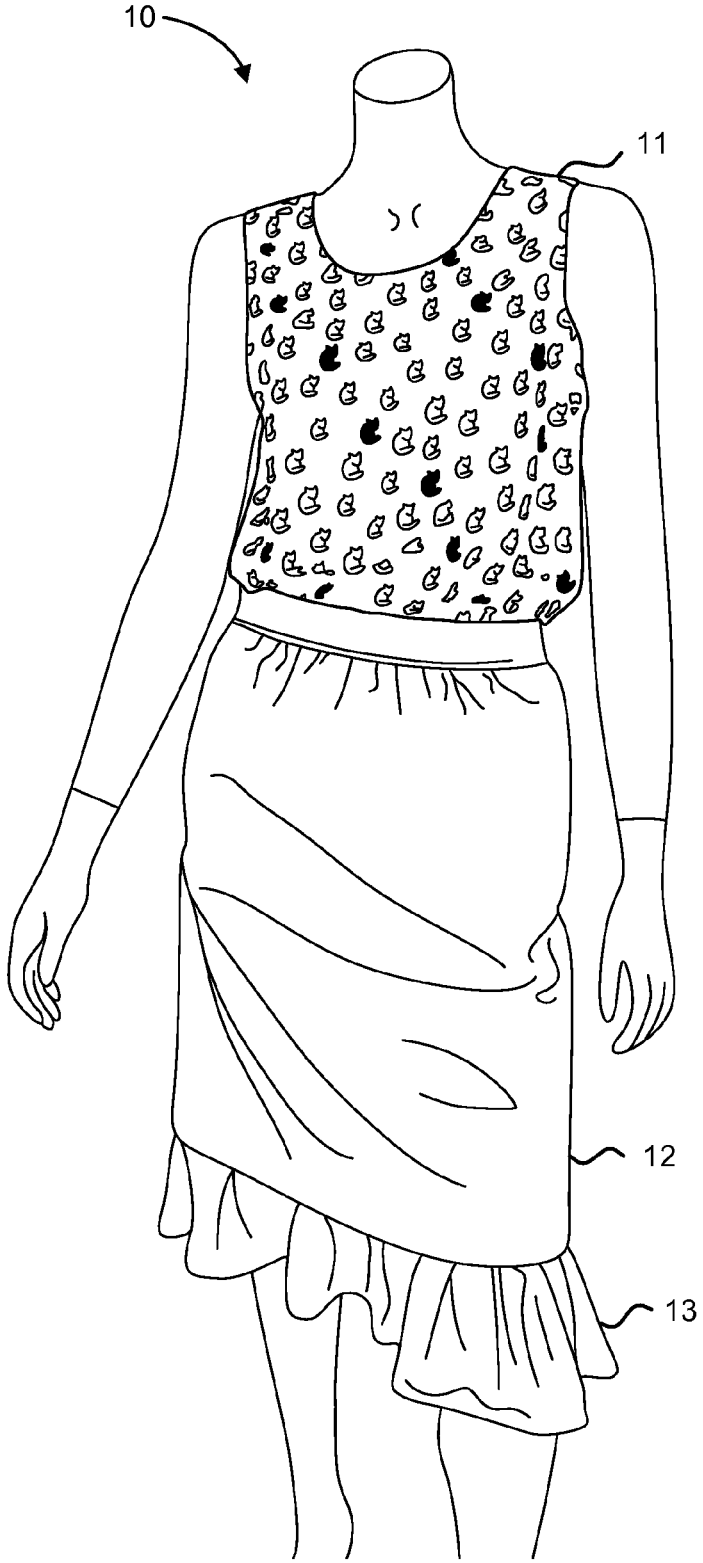
FIG. 1 is a front view of a clothing outfit with an adjustable clothing garment, in accordance with one embodiment.

The look and style of a clothing garment or outfit can be converted to a different look and style using an interchangeable clothing item. FIG. 1 is a front view of a clothing outfit with an adjustable clothing garment, in accordance with one embodiment. The clothing outfit includes adjustable garments, including a tank top 11 and skirt 12, and an interchangeable clothing trim 13. Specifically, the tank top 11 is tucked into the skirt 12, which is extended by the interchangeable clothing trim 13. Different interchangeable clothing trims can be used, such as trims with different lengths, patterns, and styles, including ruffled and straight. Other types of trims are possible. Further, more than one interchangeable clothing trim can be attached to the skirt. In a further embodiment, the outfit can change by removing the interchangeable clothing trim or replacing the interchangeable clothing trim as shown with a different interchangeable clothing trim, such as one that is longer, has a different pattern or color, or that is straight, rather than ruffled.

Figure 2:
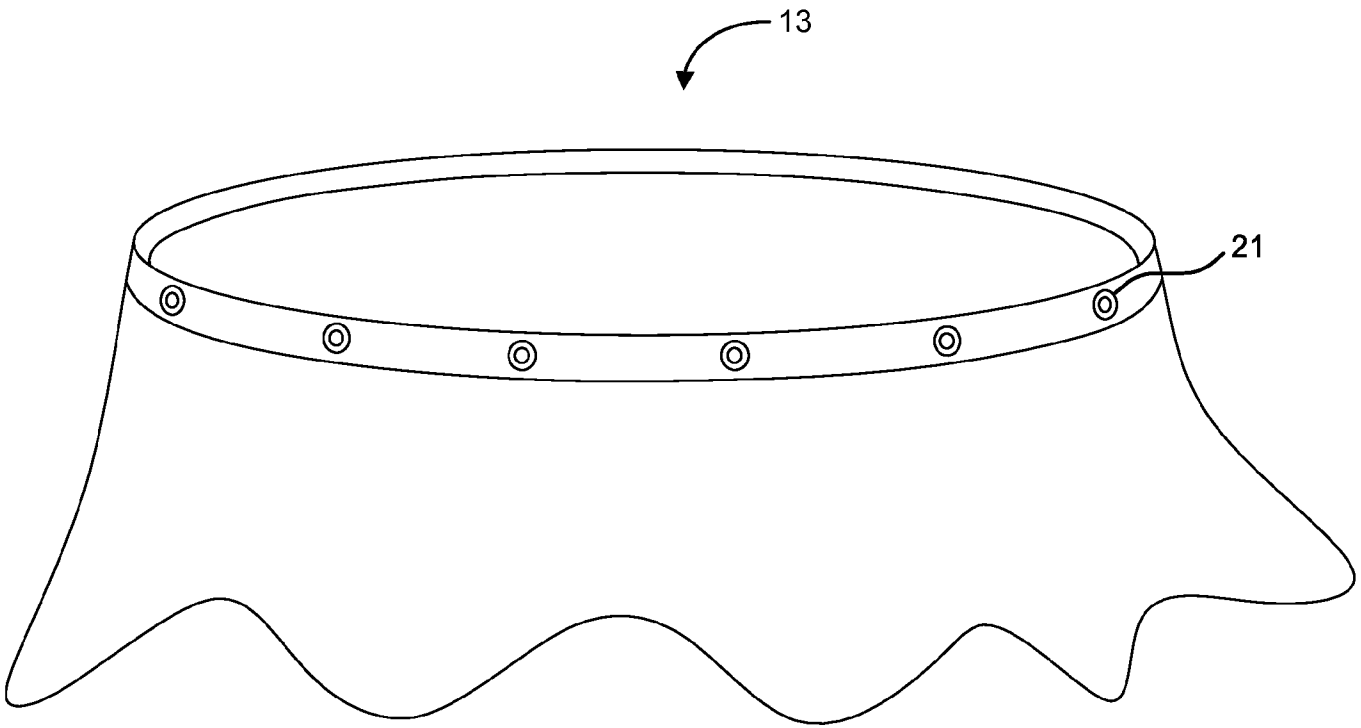
FIG. 2 is a front view showing, by way of example, an interchangeable clothing trim.

The interchangeable clothing trim 13 allows a wearer to change the look and style of one clothing item or to convert the clothing item to a different clothing item. FIG. 2 is a front view showing, by way of example, an interchangeable clothing trim 13. The interchangeable clothing trim 13 can have a tube or cone shape, and can be affixed to a bottom edge of an adjustable clothing item, such as a skirt, shirt, or dress. In one embodiment, the interchangeable clothing trim 13 can be a flat piece of material that can form the tube or cone shape when attached to the skirt, shirt, or dress. Alternatively, the interchangeable clothing trim can be provided in the shape of a tube or cone, similar to a skirt, prior to connecting to the clothing item. The shape of the interchangeable clothing trim can be ruffled or straight, and the interchangeable clothing trim can be made from one or more pieces of material, such as cotton, silk, polyester, denim, wool, fur, leather, spandex, flannel, or rayon, as well as other types of materials, and can include one or more patterns.

When worn, the interchangeable clothing trim 13 can be removeably connected to a bottom edge of a clothing item via a fastening strip 21, including snaps, zippers, or buttons, as well as other types of fastening strips, to elongate a length of the clothing item and transform a look and style of the clothing item. Specifically, one fastening strip 21 can be affixed to an outside surface of the interchangeable clothing trim 13 along a top edge, while a corresponding fastening strip (not shown) is affixed to a bottom edge of the clothing item to which the interchangeable clothing trim is to be connected. The fastening strips can be sewn via thread or otherwise attached to the interchangeable clothing trim via an adhesive, such as glue, Velcro, paste, or other types of adhesive materials. At a minimum, the fastening strips should allow addition and removal of the interchangeable clothing trim to and from the adjustable clothing item. The fastening strips can be attached along an entire circumference of the top or bottom ends of the clothing item or interchangeable clothing trim or only a portion of the circumference.

Figure 3:
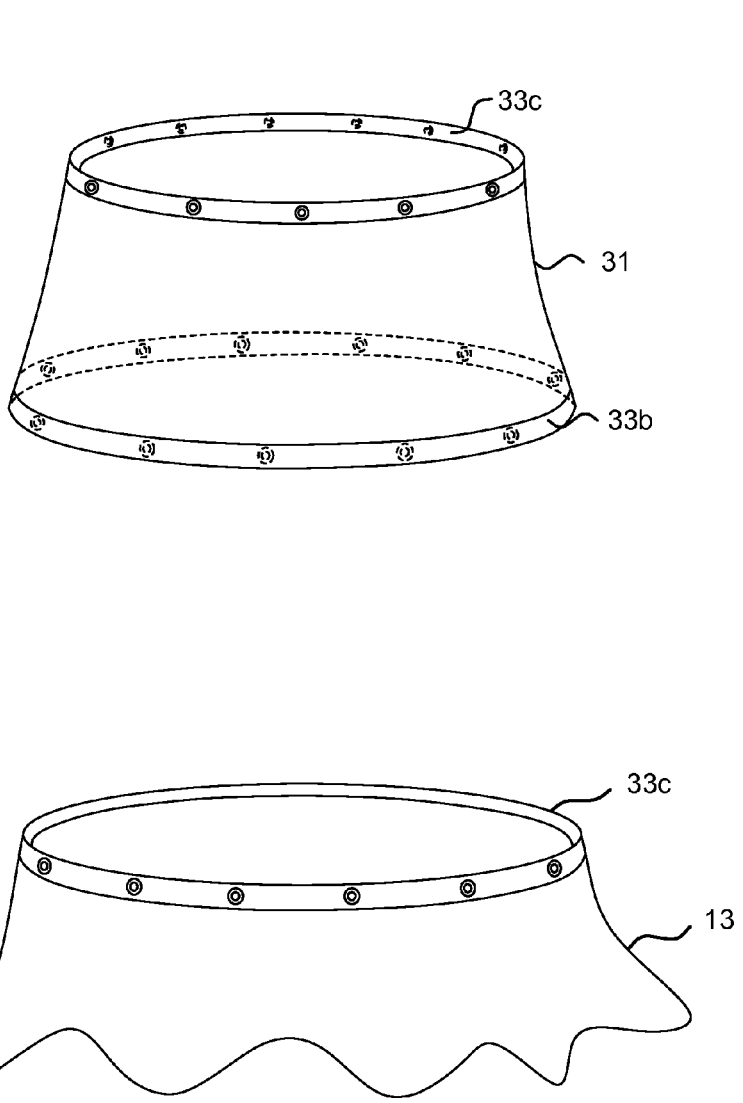
FIG. 3 is a front view showing, by way of example, an extension trim and the interchangeable clothing trim of FIG. 2.

In a further embodiment, the interchangeable trim can be attached to a trim extension that is connected to the clothing item. FIG. 3 is a front view 30 showing, by way of example, the interchangeable clothing trim 13 of FIG. 2 and an extension trim 31. As described above with respect to FIG. 2, the interchangeable clothing trim 13 can have a tube or cone shape, and one side of a fastening strip 33*c* is affixed on an outside surface of the interchangeable clothing trim at a top edge. Meanwhile, the extension trim 31 can also have a tube or cone shape similar to the interchangeable clothing trim 13. The shape of the extension trim can be preformed or can be substantially flat until the extension trim is affixed to the clothing item when the extension trim forms a tube or cone shape. Further, the extension trim can be flat, ruffled, have different patterns, and can made from different types of materials, as provided above. One fastening strip 33*a* can be affixed on an outside surface of the extension trim at a top edge and a further fastening strip 33*b* can be affixed on the inside surface at a bottom edge of the extension trim. The fastening strips attached to the top and bottom sides of the extension trim can be the same or different sides of corresponding fasteners. When the fastening strip is a series of snaps, one side includes a series of sockets, while the corresponding side includes a series of corresponding studs. When the fastening strips on the extension trim are the same, either sockets or studs can be used. Alternatively, the fastening strips can be different and the top fastening strip can include sockets, while the bottom fastening strip includes studs, or vice versa. Use of the different sides of the fastening strip is dependent on the clothing items to which the interchangeable clothing trim 13 and extension trim 31 are to be attached.

The extension trim 31 can be affixed to a bottom side of a clothing item, such as a skirt, shirt, or dress. The interchangeable clothing trim 13 can then be attached to a bottom side of the extension trim to provide a different look and style of the clothing item. To ensure connection of the clothing item (not shown), interchangeable clothing trim 13, and extension trim 31, the fastening strips must be appropriately placed. In one example, all fastening strips located on a top edge of the clothing item, interchangeable clothing trim, and extension trim can be the same side, such as a series of sockets or studs, while the fastening strips located on a bottom edge can be the opposite side of the top fastening strips.

Figure 4:
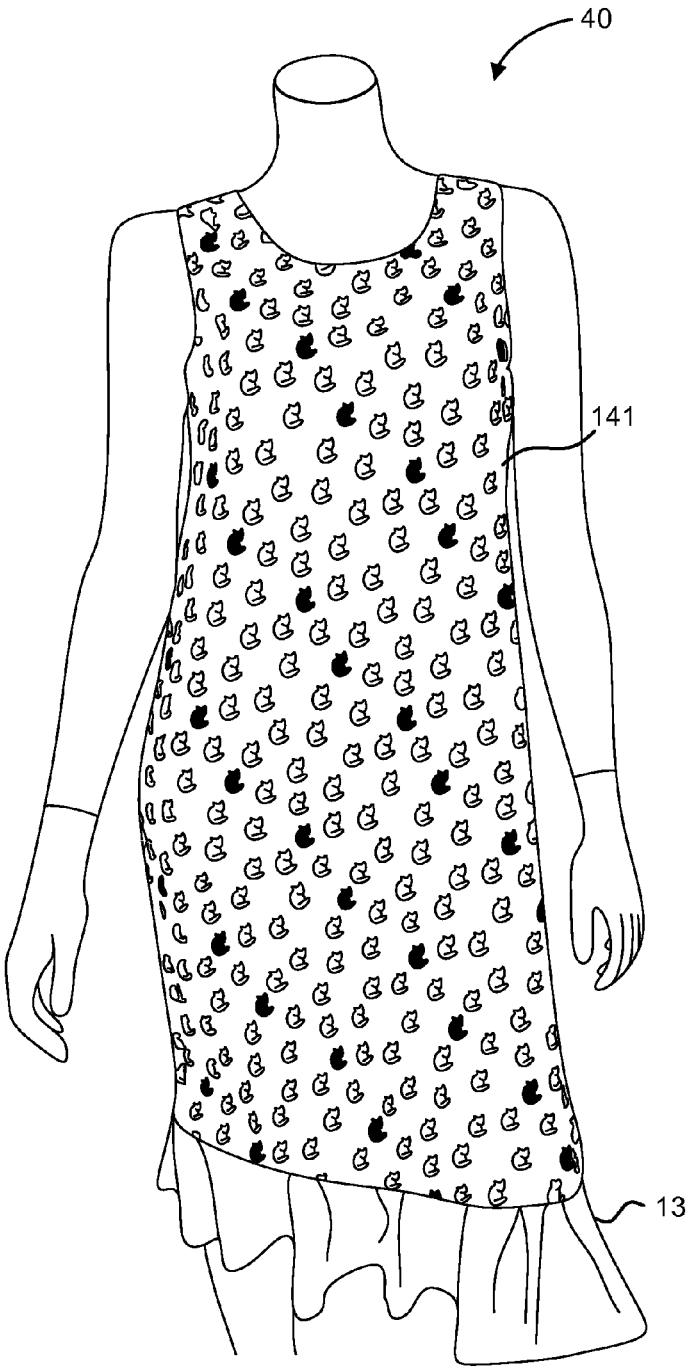
FIG. 4 is a front view showing, by way of example, a different style of the adjustable clothing garment of FIG. 1.

As described above, the interchangeable trim and extension trim can be applied to many different clothing items, including a skirt, as shown in FIG. 1, a shirt, and a dress. FIG. 4 is a front view showing, by way of example, a different style 40 of the adjustable clothing garment of FIG. 1. As described above, the tank top of FIG. 1 is tucked into the skirt. A length of the tank top extends past the hips of a wearer to form a dress 41 and is covered when worn with the skirt shown in FIG. 1. The dress 41 can be converted to a different style or length using the interchangeable clothing trim 13 or extension trim (not shown) by connecting the fastening strip of the interchangeable clothing trim or extension trim to a corresponding fastening strip along a bottom edge of the dress 41. Specifically, the style of the dress 41 can be converted to a different style based on a shape of the dress, such as by adding ruffles or adding different patterns via the interchangeable clothing trim and extension trim, if used. Thus, the dress of FIG. 4 is converted to a different outfit than the skirt and shirt combination shown in FIG. 1. However, all the same clothing items are used. Further, in a different embodiment, a knee-length dress can be converted to an ankle length dress by adding one or more interchangeable clothing trims and extension trims.

Figure 5:
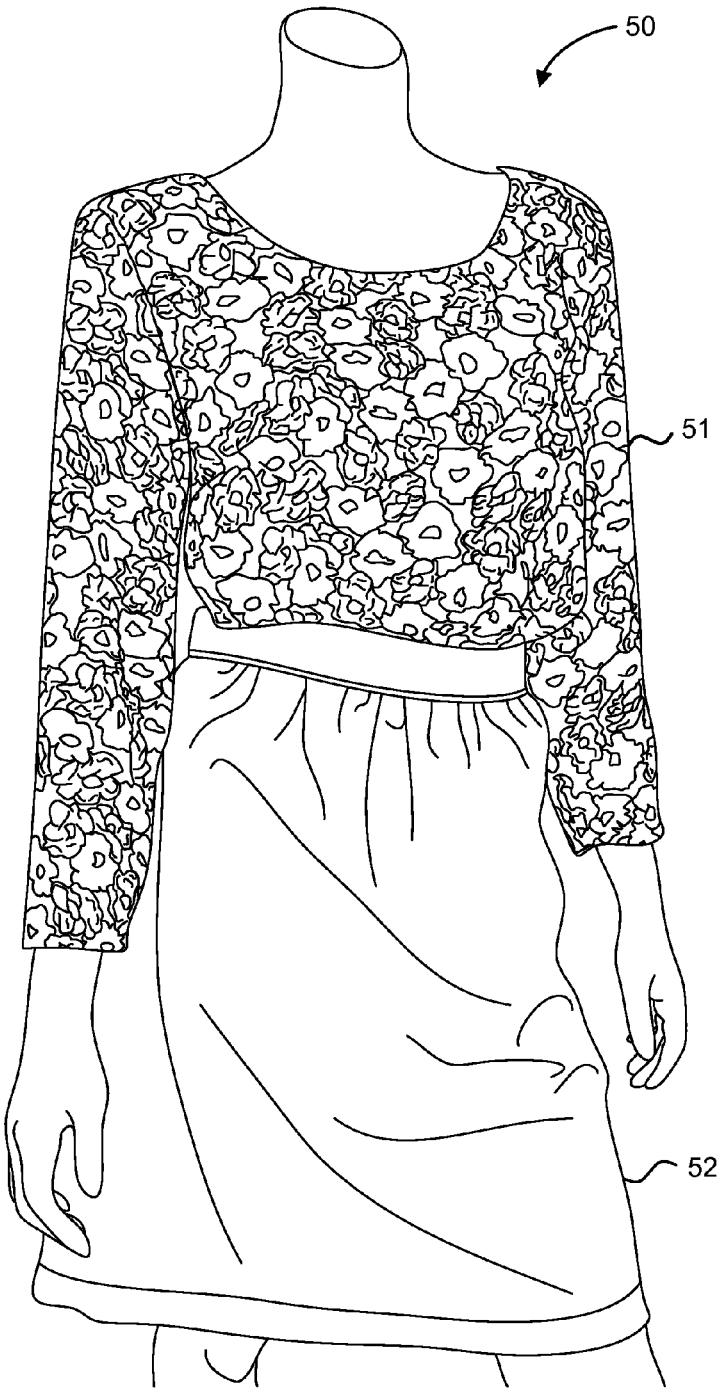
FIG. 5 is a front view showing, by way of example, a further adjustable clothing garment.
Figure 6:
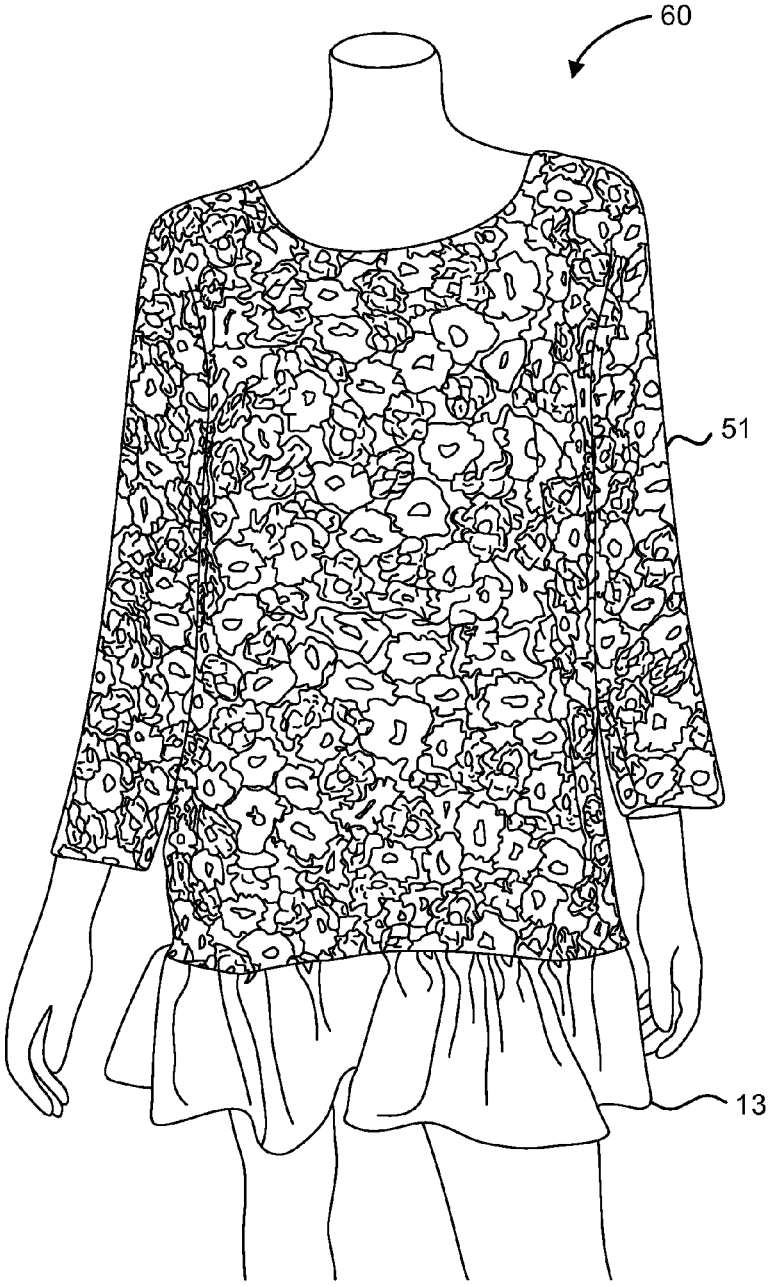
FIG. 6 is a front view showing, by way of example, a different style of the further adjustable clothing garment of FIG. 5.

In yet a further embodiment, a shirt can be transformed into a dress. FIG. 5 is a front view showing, by way of example, a further outfit 50 with an adjustable clothing garment. The clothing garment includes a skirt 51 and a shirt 52, which is tucked into the skirt. FIG. 6 is a front view showing, by way of example, a different style 60 of the further outfit of FIG. 5. To quickly convert the outfit of FIG. 5 to a different outfit, a wearer can remove the skirt 52, while leaving the shirt 51 on and then apply the interchangeable clothing trim 13 to a bottom of the shirt 51 by connecting a fastening strip on the bottom edge of the shirt with a corresponding fastening strip along a top edge of the interchangeable clothing trim 13. In a further embodiment, the wearer can attach one or more extendible trims to increase the length of the newly styled dress or create different look by forming a layered skirt portion of the dress with multiple extension trims and interchangeable clothing trims. The interchangeable trims and extendible trims can each have a different pattern or style to create a unique clothing option different from the wearer's current clothing garment.

In a still further embodiment, the sleeves of a dress or shirt can be removeable, such that sleeves of different lengths, patterns, and colors can be removeably affixed to a clothing garment. For example, a knee-length black dress includes sleeves that extend to a wearer's elbows. The wearer wishes to wear the dress to a summer event and can remove the sleeves, which results in a sleeveless black dress. Further, in the winter, the wearer can add long sleeves to the black dress to keep warm. Styles of the sleeves can also be interchanged. For examples, puff sleeves can replace with flutter sleeves or straight sleeves.

While the invention has been particularly shown and described as referenced to the embodiments thereof, those skilled in the art will understand that the foregoing and other changes in form and detail may be made therein without departing from the spirit and scope.

What is claimed is:

1. A convertible clothing garment kit, comprising:

a shirt shaped to cover at least a portion of a wearer's upper body and having attached on a bottom edge, a series of snaps;

a skirt shaped to cover at least a portion of the wearer's lower body and comprising on each of a top edge and a bottom edge, a series of snaps, wherein the series of snaps on the top edge correspond with the series of snaps on the shirt; and a ruffle comprising a substantially circular shape with a series of snaps affixed on a top edge of the ruffle that correspond with the series of snaps on the bottom edge of the skirt.

2. A convertible clothing garment kit according to claim 1, wherein the ruffle is made of the same or different material than the shirt and skirt.

3. A convertible clothing garment kit according to claim 1, wherein each of the series of snaps on the shirt, skirt, and ruffle are affixed via one of an adhesive and thread.

4. A convertible clothing garment kit according to claim 1, further comprising:

a further ruffle comprising a substantially circular shape with a series of snaps attachable to another series snaps affixed to the ruffle on a bottom edge.

5. A convertible clothing garment kit according to claim 1, further comprising:

a further series of snaps affixed to a bottom edge of the ruffle and shaped to connect with a different ruffle.

6. A convertible clothing garment kit according to claim 1, further comprising:

a set of sleeves interchangeably affixed to the shirt.

7. A convertible clothing garment kit, comprising:

a skirt comprising a series of snaps on a bottom edge;

a shirt comprising a different series of snaps on a bottom edge;

a ruffle comprising a series of snaps on a top edge of the ruffle that corresponds to the series of snaps on both of the skirt and the shirt, wherein the ruffle is interchangeably connected with the skirt and shirt; and a dress comprising a series of snaps on a bottom edge of the dress, wherein the series of snaps on the top edge of the ruffle correspond with the series of snaps on the bottom edge of the dress.

8. A convertible clothing garment kit according to claim 7, wherein the ruffle can be made of the same or different material than the skirt and the shirt.

9. A convertible clothing garment kit according to claim 7, wherein the series of snaps on the skirt and the shirt, and the corresponding snaps on the ruffle are affixed via one of an adhesive and thread.

10. A convertible clothing garment kit according to claim 7, further comprising:

a further series of snaps on the skirt;

a shirt comprising a series of snaps corresponding to the further snaps of the skirt; and a set of sleeves interchangeably affixed to the shirt.

* * * * *